US008852363B2

(12) United States Patent
Numano et al.

(10) Patent No.: US 8,852,363 B2
(45) Date of Patent: Oct. 7, 2014

(54) MAGNESIUM ALLOY SHEET MATERIAL

(75) Inventors: Masatada Numano, Osaka (JP); Nozomu Kawabe, Osaka (JP); Yukihiro Oishi, Osaka (JP); Nobuyuki Mori, Osaka (JP); Nobuyuki Okuda, Osaka (JP); Ryuichi Inoue, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 12/864,419

(22) PCT Filed: Jan. 14, 2009

(86) PCT No.: PCT/JP2009/000110

§ 371 (c)(1),
(2), (4) Date: Jul. 23, 2010

(87) PCT Pub. No.: WO2009/093420

PCT Pub. Date: Jul. 30, 2009

(65) Prior Publication Data

US 2011/0003139 A1 Jan. 6, 2011

(30) Foreign Application Priority Data

Jan. 24, 2008 (JP) ..... 2008-014210

(51) Int. Cl.

| | |
|---|---|
| ***C22C 23/02*** | (2006.01) |
| ***C22F 1/06*** | (2006.01) |
| ***B22D 19/04*** | (2006.01) |
| ***B22D 21/00*** | (2006.01) |
| ***C22C 32/00*** | (2006.01) |
| ***B22D 11/00*** | (2006.01) |

(52) U.S. Cl.

CPC . *C22F 1/06* (2013.01); *B22D 19/04* (2013.01); *B22D 21/007* (2013.01); *C22C 32/0063* (2013.01); *B22D 11/007* (2013.01); *C22C 23/02* (2013.01)

USPC ..... 148/404; 428/323

(58) Field of Classification Search

CPC ... C22C 23/02; C22C 32/0063; B22D 11/007

USPC ..... 148/404; 164/482; 428/323

See application file for complete search history.

(56) References Cited

U.S. PATENT DOCUMENTS 4,973,393 A * 11/1990 Mino et al. ..... 148/535
5,273,569 A * 12/1993 Gilman et al. ..... 75/230

(Continued)

FOREIGN PATENT DOCUMENTS

CN 1210042 A 3/1999
CN 101010152 A 8/2007

(Continued)

OTHER PUBLICATIONS

Japanese Notification of Reasons for Rejection, w/ English translation thereof, issued in Japanese Patent Application No. JP 2008-014210 dated Aug. 18, 2010.

(Continued)

*Primary Examiner* — Jie Yang

(74) *Attorney, Agent, or Firm* — McDermott Will & Emery LLP

(57) ABSTRACT

The invention offers a magnesium alloy sheet material having excellent plastic processibility and rigidity and a magnesium alloy formed body having excellent rigidity. The sheet material has magnesium alloy that forms the matrix containing hard particles. The region from the surface of the sheet material to a position away from the surface by 40% of the thickness of the sheet material is defined as the surface region, and the remaining region as the center region. Hard particles existing in the center region have a maximum diameter of more than 20 μm and less than 50 μm, and hard particles existing in the surface region have a maximum diameter of 20 μm or less. Because the hard particles existing at the surface side are fine particles, they are less likely to become the starting point of cracking or another defect at the time of plastic processing. Because the hard particles existing in the center region are coarse, they can increase the rigidity of the sheet material.

17 Claims, 2 Drawing Sheets

(56) References Cited

U.S. PATENT DOCUMENTS

| | | | | |
|---|---|---|---|---|
| 6,250,364 | B1 * | 6/2001 | Chung et al. | 164/97 |
| 6,904,954 | B2 * | 6/2005 | Nishikawa et al. | 164/482 |
| 7,841,380 | B2 * | 11/2010 | Numano et al. | 164/459 |
| 2004/0084173 | A1 | 5/2004 | Nishikawa et al. | |
| 2005/0158202 | A1 | 7/2005 | Nishikawa et al. | |
| 2006/0266495 | A1 | 11/2006 | Nishikawa et al. | |

FOREIGN PATENT DOCUMENTS

| | | | |
|---|---|---|---|
| JP | 63-243248 | | 10/1988 |
| JP | 04-066262 | | 3/1992 |
| JP | 09-104942 | A | 4/1997 |
| JP | 11-036035 | | 2/1999 |
| JP | 2003-239033 | | 8/2003 |
| JP | 2004-263254 | | 9/2004 |
| JP | 2005-068469 | A | 3/2005 |
| JP | 2006-028548 | A | 2/2006 |
| JP | 2006-144043 | | 6/2006 |
| JP | 2009-007606 | | 1/2009 |
| JP | 5209162 | B2 | 6/2013 |
| RU | 2006100687 | A | 7/2007 |
| TW | 593693 | | 12/1989 |
| TW | 200702451 | | 1/2007 |
| UZ | 3387 | C | 6/2007 |
| WO | 01/44529 | A1 | 6/2001 |
| WO | WO 02/083341 | A1 | 10/2002 |
| WO | WO-2004112992 | A2 | 12/2004 |
| WO | 2006/003833 | A1 | 1/2006 |
| WO | WO 2006/003899 | A1 | 1/2006 |
| WO | 2006/104028 | A1 | 10/2006 |

OTHER PUBLICATIONS

Russian Decision to Grant in Russian Application No. 2010135345, mailed Dec. 25, 2012.

Taiwanese Notification for the Opinion of Examination dated Mar. 21, 2014 issued in Taiwanese Application No. 098102362, w/English translation.

M. Numano et al., "Properties of AZ31 and AZ91 Sheets made by Twin Roll Casting," Materials Science Forum, vols. 539-543 (2007), pp. 1650-1655.

Extended European Search Report issued in European Application No. 09704841.7 dated Jul. 1, 2014.

* cited by examiner

MAGNESIUM ALLOY SHEET MATERIAL

RELATED APPLICATIONS

This application is the U.S. National Phase under 35 U.S.C. §371 of International Application No. PCT/JP2009/000110, filed on Jan. 14, 2009, which in turn claims the benefit of Japanese Application No. 2008-014210, filed on Jan. 24, 2008, the disclosures of which Applications are incorporated by reference herein.

RELATED APPLICATIONS

This application is the U.S. National Phase under 35 U.S.C. §371 of International Application No. PCT/JP2009/000110, filed on Jan. 14, 2009, which in turn claims the benefit of Japanese Application No. 2008-014210, filed on Jan. 24, 2008, the disclosures of which Applications are incorporated by reference herein.

TECHNICAL FIELD

The present invention relates to a magnesium alloy sheet material and a formed body produced by performing plastic processing on the sheet material. In particular, the present invention relates to a magnesium alloy sheet material that has not only excellent plastic processibility but also high rigidity.

BACKGROUND ART

Magnesium alloys formed by adding various elements to magnesium have so far been used for housing cases of portable electrical devices, such as a cellular mobile telephone and a notebook-type personal computer, parts of automobiles, and so on. Because a magnesium alloy has a hexagonal-crystal structure (a hexagonal close-packed (hcp) structure), it has poor plastic processibility at the ordinary temperature. Consequently, the above-described magnesium alloy products such as the housing cases are mainly produced by using a cast material formed through the die-casting process or thixomold process.

To improve the plastic processibility of the magnesium alloy, Patent Literature 1 has proposed to disperse a plurality of precipitated substances in the crystal grain of the magnesium alloy, the precipitated substances each having an area of $25\times10^{-12}\ \pi\ m^2$ or more and $2{,}500\times10^{-12}\ \pi\ m^2$ or less (the diameter of the circle having the same area: 10 to 100 μm). Patent Literature 2 has disclosed that the plastic processibility (formability) becomes excellent when the crystalline precipitated substance in the magnesium alloy is fine-grained such that it has a maximum diameter of 20 μm or less.

Patent Literature 1: the published Japanese patent application Tokukai 2003-239033

Patent Literature 2: the internationally published pamphlet 06/003899

DISCLOSURE OF THE INVENTION

Problem to be Solved by the Invention

In the common plastic processing, forging is a typical processing that is less likely to develop cracking. In forging, also, it appears that the precipitated substance is desirable to have a maximum diameter of 20 μm or less. However, the magnesium alloy formed or fabricated material stated in Patent Literature 1 contains precipitated substances uniformly throughout its entire body. Consequently, it may have relatively coarse precipitated substances at the surface side. When a raw workpiece contains coarse precipitated substances with a size of more than 20 μm at the surface side, cracking and other defects are likely to develop at the time of the plastic processing, thereby decreasing the plastic processibility.

On the other hand, although the magnesium alloy material described in Patent Literature 2 contains crystalline precipitated substances throughout its entire body, the precipitated substances have a maximum diameter of 20 μm or less. Therefore, the material is less likely to develop cracking and other defects at the time of the plastic processing, so that it has excellent plastic processibility. Nevertheless, when the thickness of the magnesium alloy material is further decreased to reduce the weight or to achieve another purpose, its rigidity is decreased. As a result, when undergoes an impact, it may suffer deformation such as an indentation.

In view of the above circumstances, an object of the present invention is to offer a magnesium alloy sheet material that is excellent in both of plastic processibility and rigidity. Another object of the present invention is to offer a magnesium alloy formed body that has excellent rigidity.

Means for Solving the Problem

When a sheet material is bent, a compressive stress acts on one surface side positioned at the inside of the bending, and a tensile stress acts on the other surface side positioned at the outside of the bending. For example, when a sheet material containing particles such as precipitated substances contains coarse precipitated substances at the surface side, the coarse precipitated substances are prone to become the starting point of cracking when the above-described stress acts. On the other hand, at the center of the sheet material in the thickness direction and in the vicinity of the center, the above-described stress does not act practically or its magnitude is smaller than that at the surface side. Consequently, even when relatively coarse precipitated substances exist at the center of the sheet material and in the vicinity of the center, it is probable that cracking and other defects are less likely to develop. In addition, precipitated substances have a rigidity higher than that of the magnesium alloy itself, which forms the matrix. A substance having high rigidity has a large coefficient of elasticity. When a sheet material contains the foregoing high-rigidity substances at its center and in the vicinity of the center, the rigidity of the sheet material can be increased. In particular, when the foregoing high-rigidity substances are coarse to a certain extent, the rigidity of the sheet material can be increased effectively. Based on this finding, it is specified that the sheet material of the present invention contains particles that have a difference in size between the surface side and the center portion.

The magnesium alloy sheet material of the present invention has a matrix formed of magnesium alloy and hard particles that are contained in the matrix and that have a coefficient of elasticity higher than that of the alloy forming the matrix. In the thickness direction of the sheet material, a region from each surface of the sheet material to a position away from the surface by 40% of the thickness of the sheet material is defined as a surface region, and the remaining region is defined as the center region. Hard particles existing in the center region have a maximum diameter of more than 20 μm and less than 50 μm, and hard particles existing in the surface region have a maximum diameter of 20 μm or less. The method of measuring the maximum diameter is described later.

Because in the sheet material of the present invention, the hard particles existing in the surface region have a maximum diameter as small as 20 μm or less, the hard particles are less prone to become the starting point of cracking and other defects at the time of the plastic processing, so that the sheet material has excellent plastic processibility. In addition, the center region of the sheet material of the present invention contains particles having high rigidity and relatively large size, in particular, particles larger than those existing in the surface region. Because the center region is a portion upon which a stress is less likely to act when the sheet material undergoes bending or the like, the plastic processibility is less prone to be impaired. Furthermore, because the sheet material of the present invention contains the above-described coarse particles in the center region, its rigidity can be increased. The present invention is explained below in further detail.

Magnesium Alloy Sheet Material

Magnesium Alloy

The sheet material of the present invention is composed practically of magnesium alloy and hard particles. The magnesium alloy is an alloy composed of more than 50 mass % magnesium (Mg), added elements, and unavoidable impurities. The types of the added elements include aluminum (Al), zinc (Zn), and manganese (Mn), for example. A magnesium alloy containing Al has excellent corrosion resistance. In particular, when containing Al with a content of 2.5 mass % or more and less than 6.5 mass %, the plastic processing can be performed easily, and when containing Al with a content of 6.5 mass % or more and 20 mass % or less, the corrosion resistance is further increased. In the case where the content is 2.5 mass % or more, as described below, when the hard particles are formed of the precipitated substances, the precipitated substances can be easily produced. In the case where the content is 20 mass % or less, the plastic processibility can be suppressed from decreasing. A magnesium alloy containing not only Al but also an element such as Zn or Mn has excellent mechanical properties, such as strength and elongation, and excellent corrosion resistance in comparison with magnesium alone. The types of the foregoing magnesium alloy include the AZ-family alloy and the AM-family alloy stipulated in the Standards of American Society for Testing and Materials (ASTM standards), more specifically, AZ31, AZ61, AZ63, AZ80, AZ81, AZ91, AM60, AM100, and the like. The adjustment of the content of the added element can produce a magnesium alloy having desired properties.

It is desirable that the above-described magnesium alloy contain silicon (Si) and calcium (Ca) with a minimum possible content. When the content of Si and Ca is low, the corrosion resistance is less likely to decrease, and the increase in the forming temperature and the like associated with the improvement in the heat resistance is less likely to be created. Specifically, it is desirable that the content be 0.5 mass % or less in total.

The magnesium alloy forming the matrix in the surface region and the magnesium alloy forming the matrix in the center region may have different compositions or the same composition. For example, a combination may be employed in which the surface region is formed of AZ31, which has excellent plastic processibility, and the center region is formed of AZ91, which has excellent anticorrosion property.

Hard Particles

Composition

It is specified in the present invention that hard particles have a coefficient of elasticity higher than that of the matrix-forming magnesium alloy (for example, AZ91, which has a coefficient of elasticity of 45 GPa). The types of the foregoing hard particles include intermetallic compounds such as Al—Mg-family precipitated substances, for example, $Al_{17}Mg_{12}$, Al—Mn-family precipitated substances, and Mg—Zn-family precipitated substances. It appears that these intermetallic compounds have a coefficient of elasticity of 200 GPa or so. The other types of hard particles include compounds that are less likely to react with magnesium, for example, silicon carbide (SiC, which has a coefficient of elasticity of 260 GPa); ceramics such as aluminum nitride (AlN, which has a coefficient of elasticity of 200 GPa) and boron nitride (BN, which has a coefficient of elasticity of 369 GPa); and single-element substances such as diamond (C, which has a coefficient of elasticity of 444 GPa). These ceramic particles and single-element particles have a coefficient of elasticity higher than that of the precipitated substances, which are intermetallic compounds, thereby enabling a further increase in the rigidity of the sheet material.

Method of Forming Hard Particles in the Sheet Material

When the hard particles are produced by precipitation, the hard particles (precipitated substances) are produced by adjusting the condition for producing the sheet material of the present invention. In this case, it is not necessary to prepare the material for the particles separately. Another method of forming the hard particles in the matrix formed of magnesium alloy uses to form the hard particles, for example, the above-described compounds or substances that are less likely to react with magnesium. In this case, these compounds or substances are inserted into a desired place of the molten matrix to the extent that the hard particles can exist in the center region of the sheet material to mix with the matrix. Through this process, the sheet material of the present invention having excellent rigidity can be produced. In the sheet material of the present invention, particles formed of precipitated substances and particles formed of ceramic may exist concurrently. Furthermore, the hard particles existing in the center region may have a composition different from that of the hard particles existing in the surface region.

Coefficient of Elasticity

The sheet material of the present invention contains hard particles having a hardness higher than that of the matrix to increase the rigidity. To further increase the rigidity of the sheet material, it is desirable that the hard particles have a hardness two or more times that of the matrix, more desirably ten or more times. In addition, it is desirable that the hard particles have a coefficient of elasticity of 50 GPa or more. When the coefficient of elasticity is 50 GPa or more, the effect of increasing the rigidity of the sheet material is high. Because the effect increases with increasing coefficient of elasticity, it is more desirable that the coefficient of elasticity be 100 GPa or more.

When the hard particles are produced through the reaction at the time of the production of the sheet material, the hard particles in the sheet material may have a different coefficient of elasticity depending on the composition ratio and crystal structure of the constituents of the hard particles. Consequently, it is desirable to measure and confirm the coefficient of elasticity of the hard particles in the sheet material as appropriate after the production of the sheet material. The coefficient of elasticity can be measured by the following method, for example. First, the center region of the produced sheet material is obtained through mechanical processing or the like. Then, the matrix (magnesium alloy) is dissolved in a chemical solution. The obtained residual is used to measure the volume of the hard particles. The elasticity of the center region is measured by a bending test. These measured results are used in the calculation of the coefficient of elasticity through the rule of mixtures. When it is difficult to obtain the desired accuracy by the method using the rule of mixtures, the physical property of the foregoing residual may be directly measured by using a micro Vickers hardness tester or the like. On the other hand, in the case where material particles to be used as the hard particles are inserted into the molten matrix, it is possible to measure the coefficient of elasticity of the material particles in advance. In this case, the material design is performed easily. At this moment, the selection of the material particles can be conducted using the coefficient of elasticity. However, when the measurement of the coefficient of elasticity is difficult because the material particles are minute or owing to another reason, the coefficient of elasticity can be estimated, for example, by measuring the hardness of the residual (particles) obtained after dissolving the matrix (magnesium alloy) of the cast material in a chemical solution.

Size

The most prominent feature of the sheet material of the present invention is that the hard particles existing at the surface side have a size (the maximum diameter) different from that of the hard particles existing at the inner portion. In the thickness direction of the sheet material, a region away from both surfaces of the sheet material by 40% or more of the thickness of the sheet material, i.e., a region that includes the center of the sheet material in the thickness direction and that accounts for 20% of the thickness of the sheet material, is defined as the center region. On the other hand, a region from each surface of the sheet material to a position away from the surface by 40% of the thickness of the sheet material, i.e., a region that exists at either side of the center region, that includes a surface of the sheet material, and that accounts for 40% of the thickness of the sheet material, is defined as a surface region. Many precipitated substances and ceramics are low in toughness such as elongation. Consequently, in the case where the hard particles are formed of such precipitated substances or the like, when the center region is excessively wide, the plastic processibility may decrease. In view of this consideration, although the sheet material of the present invention is specified to have a center region that accounts for 20% of the thickness of the sheet, it is desirable that the center region account for 10% of the thickness of the sheet, i.e., the surface region extend from the surface of the sheet material to a position away from the surface by 45% of the thickness of the sheet, to have a further improved plastic processibility. In addition, the hard particles existing in the surface region (hereinafter referred to as surface particles) are specified to have a maximum diameter of 20 μm or less in order not to impair the plastic deformability. It is specified that the maximum diameter of a hard particle is the maximum length of the hard particle in the thickness direction of the sheet material. It is desirable that the surface particles be as small as possible, more desirably 5 μm or less. In particular, in consideration of the corrosion resistance and the designability such as the paintability of the sheet material, it is desirable that the number of hard particles exposing at the outermost surface of the sheet material be as small as possible and that they have a maximum diameter of 5 μm or less, more desirably 1 μm or less. Furthermore, in consideration of the above-described designability, it is desirable that practically no hard particles exist at the outermost surface of the sheet material. When the surface of the sheet material is not smooth for the actual use, processing for the rectification, such as surface cutting or polishing, is sometimes performed. In this case, the center and surface regions are determined after the processing for the rectification.

When magnesium alloy undergoes a casting operation, precipitated substances are usually produced. Consequently, when the surface particles are formed of the precipitated substances, the control of the production condition can adjust the size of the surface particles so as to fall within the foregoing specified range. When ceramic particles are included in the surface particles, it is desirable to use ceramic particles having the size within the foregoing specified range. The surface particles may either be dispersed uniformly throughout the entire surface region or be distributed such that the number of particles is gradually decreased as the position approaches the surface, i.e., the number of particles is gradually increased as the position approaches the center. The state of dispersion can be adjusted by controlling the production condition, for example. The detailed control method is described later.

On the other hand, the hard particles existing in the center region (hereinafter referred to as inner particles) are specified to have a maximum diameter of more than 20 μm in order to increase the rigidity. The inner particles can increase the rigidity as their size increases. Nevertheless, if the size is excessively large, the plastic processibility is decreased. Therefore, the maximum diameter is specified to be less than 50 μm. It is desirable that the maximum diameter be more than 20 μm and not more than 40 μm.

Content

As for the content of the surface particles, it is desirable that the surface particles account for 0.5 vol. % or more and 15 vol. % or less of the total volume of the sheet material. When the content of the surface particles is controlled to fall within the above-described range, the difference in the material property with the center region can be reduced, so that the plastic processibility of the sheet material can be suppressed from decreasing. On the other hand, if the center region does not contain the hard particles to a certain degree, the rigidity cannot be increased sufficiently. If the content is excessively high, the sheet material tends to be brittle. As for the specific content of the inner particles, it is desirable that the inner particles account for 0.5 vol. % or more and less than 15 vol. % of the total volume of the sheet material. When the hard particles are formed of the precipitated substances, the content of the hard particles can be adjusted by adjusting the composition of the magnesium alloy or by controlling the production condition. When the hard particles are formed of ceramic particles, the content of the hard particles can be adjusted by adjusting the quantity of the ceramic particles at the time of the mixing.

Form

Typical forms of the sheet material of the present invention are a cast material, a material obtained by performing a primary plastic processing such as rolling or extrusion on the cast material, and a primarily processed material obtained by further performing heat treatment on the material having undergone the primary plastic processing. The foregoing cast material has fine hard particles at the surface side practically without containing relatively coarse hard particles in the surface region. Consequently, it is less likely to develop cracking and other defects at the time of the rolling or the like, so that it has excellent plastic processibility. In addition, by performing the primary plastic processing on the above-described cast material, the defects and the like produced at the time of the casting can be eliminated to improve the surface properties. In particular, the sheet material having undergone a rolling processing with a total rolling reduction of 30% or more has not only enhanced surface properties but also better mechanical properties, such as tensile strength and elongation, in comparison with those of the cast material. When the cast material is subjected to a plastic processing such as rolling, a strain is introduced into it. Accordingly, the sheet material of the present invention may be a sheet material having undergone a heat treatment aiming at removing the strain after the plastic processing. The obtained primarily processed material, also, has excellent plastic processibility as with the cast material and therefore is less likely to develop cracking and other defects at the time of a secondary plastic processing such as pressing or forging.

Thickness

The sheet material of the present invention can have a different thickness by adjusting the production condition. In particular, the performing of a rolling or another operation can produce a thin sheet having a thickness of 1 mm or less. Because the sheet material of the present invention has an increased rigidity owing to the existence of relatively coarse inner particles in the center region, even the above-described thin sheet is less prone to develop deformation such as an indentation.

Covering Layer

The sheet material of the present invention may be provided with a covering layer on its surface. The representative types of covering layer include an anticorrosion layer formed through anticorrosion treatment (chemical-conversion treatment or anodic-oxidation treatment) and a painted layer aiming at decoration and the like. When provided with an anticorrosion layer, the corrosion resistance can be increased, and when provided with a painted layer, the commercial value is enhanced. When the sheet material of the present invention undergoes a plastic processing, because the anticorrosion layer is less likely to be damaged by the plastic processing, the anticorrosion layer may be formed either before or after the plastic processing. When the anticorrosion layer is provided before the plastic processing, the anticorrosion layer is likely to act as a lubricant at the time of the plastic processing. Because the painted layer may be damaged by the plastic processing, it is desirable that the painted layer be formed after the plastic processing.

Formed Body

A magnesium alloy formed body of the present invention can be obtained by performing a secondary plastic processing, such as pressing or forging, on the primarily processed material (the sheet material of the present invention) having undergone a primary plastic processing, such as rolling. As with the sheet material of the present invention, the formed body of the present invention contains relatively coarse inner particles in the center region. Therefore, it has high rigidity and is less likely to develop deformation.

The formed body of the present invention may be provided with a covering layer. It is particularly desirable that the covering layer be composed of an anticorrosion layer and a painted layer.

Production Method

When the magnesium alloy sheet material of the present invention is produced as a cast material, it can be produced through the following production method, for example.

Production of a Cast Material

In the Case where Hard Particles in Both Regions are Formed of Precipitated Substances In the case where hard particles existing in the magnesium alloy sheet material of the present invention are formed of precipitated substances, the production process includes a step of preparing a molten metal of magnesium alloy and a step of casting the molten metal to form a sheet material, for example. In the casting step, cooling is performed such that the cooling rate of the surface of the molten metal becomes 50 K/sec or more and 1,000 K/sec or less, and the time required to attain the final solidification is controlled. More directly, the molten metal is solidifying with a temperature difference being provided between the surface side and the center portion. In particular, the surface side is rapidly cooled so that coarse precipitated substances can be prevented from forming at the surface side. In addition, the solidification time is controlled such that the interior is cooled slowly so that coarse precipitated substances can be formed at the center of the sheet material in the thickness direction and in the vicinity of the center. The solidification time can be controlled by adjusting the casting speed, for example.

When the cooling rate is decreased, central segregation develops. The central segregation exists dispersedly lengthwise and widthwise in the sheet material and is usually treated as a defect. In view of this phenomenon, the cooling rate and casting speed are controlled as described above to control the central segregation, so that the sheet material is formed such that relatively coarse precipitated substances are continuously linked together lengthwise and widthwise in the sheet material. Consequently, the hard particles formed of precipitated substances can have a size increased in a direction other than the thickness direction, for example, in the length direction or width direction. In the present invention, the dimension in the thickness direction of a hard particle is defined as the diameter. When a hard particle has an excessively large dimension in a direction perpendicular to the thickness direction of the sheet (in the length or width direction), the hard particle is likely to become the starting point of cracking owing to, for example, the development of separation at the interface between the hard particle and the matrix. Accordingly, it is desirable that the hard particles have a maximum length of 2 mm or less in a direction perpendicular to the thickness direction of the sheet. In particular, in order to increase the rigidity while suppressing the decrease in tensile strength, it is desirable that the aspect ratio of a hard particle be 1:10 or less (the aspect ratio of a hard particle is defined as the ratio of the maximum diameter of the hard particle (the maximum length of the hard particle in the thickness direction of the sheet) to the maximum length of the hard particle in the direction at which the length is the longest (out of the thickness, length, and width directions)). To further increase the rigidity, it is desirable that the foregoing aspect ratio be 1:20 or more. When this ratio is employed, however, the number of particles decreases in relation to the volume, thereby decreasing the number of dispersion points of the stress produced at the time of the plastic processing. As a result, the tensile strength tends to decrease.

It is desirable that the casting be performed through a continuous casting process such as the twin-roll process, the twin-belt process, or the belt-and-wheel process, all of which use movable casting molds. These casting processes have a structure in which the position of the mold surface (the surface making contact with the molten metal) is easily maintained constant and the surface making contact with the molten metal appears continuously as the casting mold rotates. Consequently, it is easy to control the above-described cooling rate and casting speed within the specified range. In addition, because the movable casting mold is produced with high precision, the cast material can be produced with high precision. Furthermore, the type of casting may either be the vertical casting, in which the molten metal is moved vertically, or be the horizontal casting, in which the molten metal is moved horizontally.

In the foregoing casting step, the rigidity can be sufficiently improved by employing the two conditions described below. One condition is that the cooling rate at the surface-side portion of the solidifying material (the portion that mainly forms the surface region of the sheet material) is set at 50 K/sec or more. This condition suppresses the formation of coarse precipitated substances having a maximum diameter of more than 20 μm at the surface side of the sheet material.

The other condition is that the time from the start of the solidification of the above-described surface-side portion to the completion of the solidification of the center portion of the solidifying material (the portion that mainly forms the center region of the sheet material) is set at 0.1 sec or more. This condition facilitates the formation of coarse precipitated substances having a maximum diameter of more than 20 μm in the center region of the sheet material. The cooling rate can be selected as appropriate according to the composition of the solidifying material (the molten metal). Specifically, it is desirable that the cooling rate be 200 K/sec or more and 1,000 K/sec or less. The adjustment of the cooling rate can be performed by adjusting the target sheet thickness for the cast material, the temperature of the molten metal and movable casting mold, the driving (rotating) speed of the movable casting mold, the contact length between the casting mold and molten metal, and the like; by selecting as appropriate the material of the movable casting mold; and by adjusting the surface condition of the casting mold, the coolant, the mold release agent, and the like.

The casting speed can be selected as appropriate in consideration of the size and composition of the material to be cast, the cooling rate, and the like. If the casting speed is excessively low, the center portion of the cast material is also cooled at a cooling rate comparable to that of the foregoing surface side. As a result, it becomes difficult to form precipitated substances having a maximum diameter of more than 20 μm. If the casting speed is excessively high, the center portion is cooled slowly. As a result, notably coarse precipitated substances having a maximum diameter of more than 50 μm may be formed.

The cooling rate and the casting speed are controlled as described above to achieve a state in which the solidification of the molten metal is not completed at the time the solidifying material leaves the movable casting mold. In other words, at the time the solidifying material leaves the movable casting mold, the surface side of the molten metal is solidified and the center portion remains unsolidified. The cooling rate and the casting speed are controlled such that after leaving the casting mold, the center portion is solidified by slow cooling. For example, in the case where the movable casting mold is formed of a pair of rolls, the molten metal is solidified such that no solidification-completed point exists at the time the molten metal passes the minimum gap, at which the two rolls come closest together, i.e., in the place from the plane including the axis of rotation of the roll to the tip of the molten metal-pouring mouth (in the offset section). Thus, coarse precipitated substances are formed in the center region. For example, the process is performed such that the entire solidifying material is not solidified at the stage at which the solidifying material leaves the casting mold. At this moment, for example, in the case where the movable casting mold is formed of a pair of rolls, because the solidifying material passing through the space between the two rolls has an unsolidified interior, the casting load becomes relatively light.

In the Case where Hard Particles in the Center Region Include a Substance Other than Precipitated Substances The sheet material of the present invention containing hard particles formed of a substance other than precipitated substances, for example, hard particles formed of ceramic particles can be produced by using a mixed molten metal formed by mixing ceramic particles and magnesium alloy. More specifically, first, a mixed molten metal is prepared that is formed by mixing desired ceramic particles and a molten metal composed of magnesium alloy having a desired composition. Then, a simultaneous casting is performed such that the foregoing mixed molten metal is sandwiched between the molten metals of matrix composed of magnesium alloy for forming the surface region. At this moment, as with the above-described production method, the cooling rate and the casting speed are controlled. The obtained sheet material has a center region composed of a composite material of magnesium alloy and ceramic particles. As described above, by using desired hard particles, the composition and size of the particles can be varied simply.

Thickness of the Cast Material

It is desirable that the cast material have a thickness of 3 mm or more and 5 mm or less. When the thickness falls in this range, not only can a long material be formed stably but also control can be conducted easily to obtain desired structure.

Heat Treatment

The obtained cast material may be subjected to a heat treatment and an aging treatment to transform the cast structure into a recrystallized structure so that the composition can be homogenized and the plastic processibility can be improved. In addition, as described later, to adjust the size of the particles such as the precipitated substances, the obtained cast material may be subjected to a heat treatment. The specific condition for the heat treatment to adjust the size of the particles is described later. It is desirable that the temperature and time be selected as appropriate in accordance with the composition of the alloy.

Primary Plastic Processing

The above-described cast material (including a material having undergone heat treatment after the casting) has excellent plastic processibility in rolling, extrusion, and the like. Consequently, by performing the above-described plastic processing, the surface properties can be improved and the mechanical properties such as tensile strength and elongation can be enhanced. In particular, when the rolling with a total rolling reduction of 20% or more is performed, the cast structure can be practically transformed into a rolled structure (a recrystallized structure). It is more desirable that the total rolling reduction be 30% or more. The rolling is performed with one pass or more. It is desirable to perform with a rolling reduction per pass of 3% to 30%, more desirably 7% to 20% to obtain a rolled material small in cracks at the edge, less likely to develop cracks, and excellent in smoothness. At the time the rolling is performed, when the surface temperature of the material to be processed is maintained in the range of 150° C. to 350° C. and the temperature of the roll is maintained in the range of 150° C. to 350° C., a rolled material can be obtained that is less likely to develop cracking and other defects and therefore has an increased processibility and that suppresses the coarsening of the crystal structure owing to the heat at the time of processing and consequently has excellent secondary processibility in pressing, forging, and the like. The obtained primarily processed material (typically, a rolled material) contains, in both regions, hard particles whose size is nearly the same as that of the as-cast material or is smaller resulting from the pulverization during the plastic processing. A primarily processed material has a thickness of, for example, 0.4 mm or more and 4.8 mm or less. A cast material undergoes rolling or the like so as to have a desired thickness.

When the above-described primary plastic processing such as rolling is performed successively after the casting, the residual heat remaining in the cast material can be used, so that the energy efficiency is improved. In the case where a primary plastic processing is not performed successively after the continuous casting, when before being processed by the primary plastic processing, the material to be processed is heat-treated for a relatively long time of about 30 minutes or more and about 50 hours or less at a temperature of 250° C. to 600° C. and not higher than the solidus temperature of the constituent materials of the material to be processed, the plastic processibility can be increased, so that the material to be processed can be prevented from cracking or deforming at the time of the primary plastic processing. The foregoing heat treatment is not required to perform depending on the composition of the constituent materials of the material to be processed.

In the case where the primary plastic processing is performed with a plurality of passes, when the material to be processed is heat-treated at every specified pass or the obtained primarily processed material is heat-treated, the remaining stress and strain introduced by the primary processing can be removed, so that the mechanical properties can be improved and the secondary plastic processibility can be enhanced. An example of the condition for the heat treatment is as follows: heating temperature: 100° C. to 600° C. and not higher than the solidus temperature of the constituent materials of the material to be processed; heating time: 5 minutes to 5 hours or so.

In the above-described rolled material having undergone the heat treatment during or after the rolling, in particular, the surface region has a fine crystal structure that is characterized by an average grain size of 0.5 μm or more and 30 μm or less, so that the rolled material has excellent secondary plastic processibility. The average grain size is obtained by the following method. First, the grain sizes in the surface region are obtained in a cross section of the rolled material through the cutting method stipulated in JIS G 0551. Then, the average value of the grain sizes is calculated. The average grain size can be varied by adjusting the rolling condition (such as the total rolling reduction and temperature) and the condition for the heat treatment (such as the temperature and time).

The obtained primarily processed material may be subjected to the below-described secondary plastic processing after forming a covering layer, particularly an anticorrosion layer.

Secondary Plastic Processing

The above-described primarily processed material (including the material that is heat-treated after the plastic processing) has excellent plastic processibility in the processing such as pressing and forging. A formed body obtained by performing the above-described plastic processing can be suitably used in various fields in which the light weight is desired. In particular, the formed body has high rigidity even with a thickness as thin as 0.3 to 1.2 mm. Consequently, it is less likely to bend or deform, so that it has a high commercial value. The formed body is not required to have a uniform thickness throughout its body. It may include partially thin or thick portions owing to the plastic processing.

It is desirable that the secondary plastic processing be performed under the condition that the plastic processibility is increased by heating the primarily processed material at room temperature or more and less than 500° C. It is desirable that heat treatment be performed after the processing. An example of the condition for the heat treatment is as follows: heating temperature: 200° C. to 450° C.; heating time: 5 minutes to 40 hours or so. When a covering layer is formed on a secondarily processed material having undergone a secondary plastic processing to produce a formed body provided with a covering layer, the formed body's corrosion resistance and commercial value are increased. When a primarily processed material is provided with an anticorrosion layer, the anticorrosion layer acts as a lubricant at the time of the secondary plastic processing, thereby facilitating the performing of the processing. When a painted layer is formed, it is desirable that the painted layer be formed after the secondary plastic processing to prevent the painted layer from being damaged at the time of the secondary plastic processing. Alternatively, after a secondary plastic processing is performed on a primarily processed material, an anticorrosion layer and a painted layer may be formed in succession.

Effect of the Invention

The magnesium alloy sheet material of the present invention has not only excellent plastic processibility but also excellent rigidity. The magnesium alloy formed body of the present invention has excellent rigidity and therefore is less likely to deform.

EXPLANATION OF SIGNS

Figure 1:
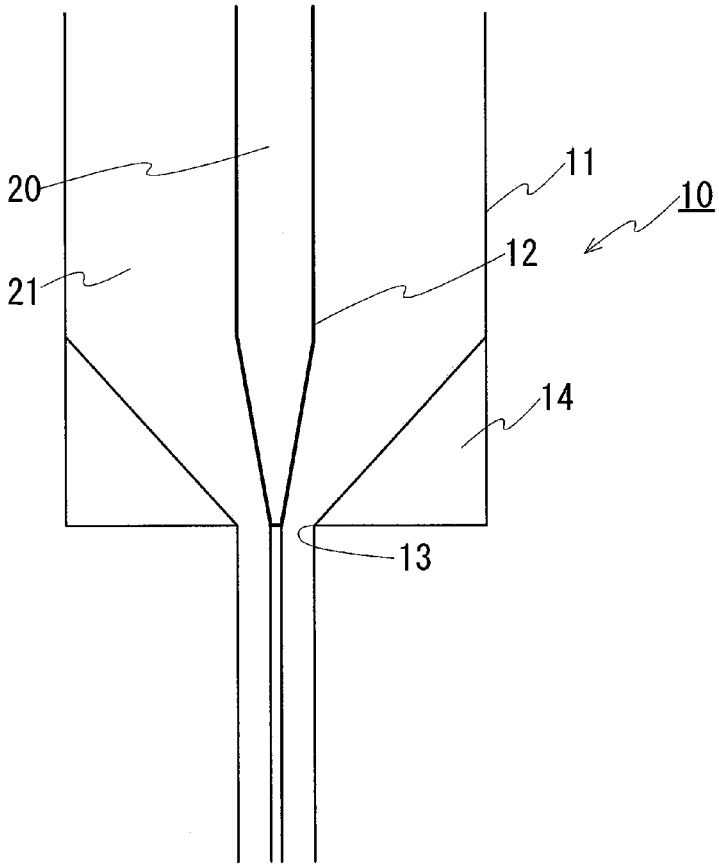
FIG. 1 is a schematic illustration showing a continuous casting apparatus to be used to produce a sheet material of the present invention by using a mixed molten metal and a surface-use molten metal.

10: Continuous casting apparatus; 11: Melting-holding furnace; 12: Partition wall; 13: Molten metal-pouring mouth; 14: Cooling mechanism 20: Mixed molten metal; 21: Surface-use molten metal

BEST MODE FOR CARRYING OUT THE INVENTION

An explanation is given below to embodiments of the present invention.

Cast materials were produced by using magnesium alloys having various compositions and by using ceramic particles as appropriate. The obtained cast materials were subjected to rolling processing as appropriate to examine their various properties.

The cast materials were produced as described below. Molten metals of magnesium alloys having the compositions shown in Table I (the remainder: Mg) were prepared. The prepared molten metals were subjected to continuous casting under the conditions shown in Table I to produce cast materials (width: 200 mm). They had a different thickness as appropriate.

TABLE I

| | Sample No. | | | | | | | | |
|---|---|---|---|---|---|---|---|---|---|
| | 1 | 2 | 3 | 4 | 5 | 6 | 7 | 8 | 9 |
| Composition of matrix (mass %) | Al:3.0% Zn:0.7% | Al:3.0% Zn:0.7% | Al:3.0% Zn:0.7% | Al:6.0% Zn:0.7% | Al:9.0% Zn:0.7% | Al:9.0% Zn:0.7% | Al:3.0% Zn:0.7% | Al:9.0% Zn:0.7% | Al:3.0% Zn:0.7% |

TABLE I-continued

| | Sample No. | | | | | | | | |
|---|---|---|---|---|---|---|---|---|---|
| | 1 | 2 | 3 | 4 | 5 | 6 | 7 | 8 | 9 |
| Add hard particles | — | — | — | — | — | — | SiC | SiC | SiC |
| Cooling rate at surface side (K/sec) | 10 | 50 | 500 | 500 | 500 | 1000 | 50 | 500 | 50 |
| Casting speed (mm/sec) | 0.75 | 3.75 | 37.5 | 37.5 | 37.5 | 75 | 3.75 | 37.5 | 3.75 |

The cast materials of Sample Nos. 1 to 6 were produced by using a continuous casting apparatus provided with a melting furnace for producing molten metal, a tundish for temporarily storing the molten metal supplied from the melting furnace, a conveying launder placed between the melting furnace and the tundish, a molten metal-pouring mouth for feeding the molten metal from the tundish to a movable casting mold, and a movable casting mold for casting the fed molten metal. In this case, a twin-roll casting apparatus was used. It is desirable to provide a heating means for maintaining the temperature of the molten metal at the periphery of the melting furnace, conveying launder, molten metal-pouring mouth, and so on. In addition, it is desirable that the casting be performed in a low-oxygen atmosphere having an oxygen content of less than 5 vol. %, for example, an atmosphere composed of one type of gas selected from the group consisting of argon, nitrogen, and carbon dioxide in order to provide a condition that the magnesium alloy is less likely to combine with oxygen. The atmosphere may be a mixed atmosphere. Furthermore, its resistance to fire may be increased by containing $SF_6$, hydrofluorocarbon, or the like with a content of 0.1 to 1.0 vol. % or so. The above description is also applied to Sample Nos. 7 to 9 described below. When a fluoride film or sulfide film is formed on the surface of the magnesium alloy molten metal using fluorine or sulfur, the oxygen concentration of the gas (atmosphere) making contact with this film may be increased. Specifically, even when the concentration is increased to 21 vol. % (the remainder: mainly nitrogen), i.e., even when the atmospheric gas is used, it was possible to produce samples without a problem.

In the case of the cast materials of Sample Nos. 1 to 6, thermocouples (made by Anritsu Meter Co., Ltd.) were placed such that the contact point of the thermocouples was always brought into contact with the surface of the solidifying material continuously emerging from the place between the rolls. Thus, the cooling rate at the surface side was obtained using the temperature of the thermocouples and the travelling distance of the solidifying material. More specifically, the cooling rate was obtained through the method described below. Temperatures were measured at the inner surface of the molten metal-pouring mouth and at the surface of the solidifying material (in this case, at a location S at which the molten metal started the contact with the casting mold and a location E at which the solidifying material ended the contact with the casting mold). A thermocouple (in this case, a welded thermocouple of 0.05 mm) was placed at the individual places and on the center portion in the width of the solidifying material continuously emerging from the molten metal-pouring mouth. Measurement was conducted on the temperature change of the solidifying material during the time during which the solidifying material traveled the section of contact with the casting mold (the section from the location S to the location E, for example, the section from the location at which the gap between the rolls was at the minimum to the location that advanced a specified distance toward the downstream side). Then, the value obtained by using formula (1) below was defined as the cooling rate at the surface side.

Formula (1): (the difference between the temperature of the molten metal at the inner surface of the molten metal-pouring mouth and the temperature measured by the thermocouple at the time the solidifying material ends the contact with the casting mold)/(the time (sec) during which the solidifying material travels the section of contact with the casting mold).

The temperature at the foregoing location S shows the starting temperature of the casting, and the temperature at the location E can be measured by moving the thermocouple at the same speed as that of the solidifying material, i.e., more specifically, by moving the thermocouple together with the solidifying material in a semisolidifying state (the same is applied to Sample Nos. 7 to 9 described later).

The cooling rate was also calculated by the following way. First, the structure in a cross section of the cast material was observed to measure the spacing between dendrites. Then, the result was substituted into formula (2) below. It was confirmed that the above-calculated result nearly agrees with the above-described actually measured result obtained by using the thermocouples. Therefore, the cooling rate may also be controlled by this method of structure observation.

$$(\text{cooling rate})=(\text{spacing between dendrites } (\mu m)/35.5)^{(-3.23)}. \quad \text{Formula (2)}$$

In this case, the cooling rate was varied by varying one condition selected from the group consisting of the temperature of the roll, surface-covering material of the roll, material of the roll, diameter of the roll, minimum gap between the rolls, and temperature of the molten metal or by varying several conditions after combining them. The casting speed was varied by varying the electric current fed into the casting apparatus. When the casting is performed with a relatively slow casting speed, problems such as the solidification of the molten metal in the gap between the rolls may be created. Therefore, it is desirable to use a vertical-type twin-roll casting apparatus.

The cast materials of Sample Nos. 7 to 9 were produced by using a molten metal for forming the surface region (hereinafter referred to as the surface-use molten metal) and a mixed molten metal for forming the center region. For the surface-use molten metal, the material having the composition of the matrix shown in Table I was prepared, For the mixed molten metal, the material was prepared by mixing SiC particles, having a maximum diameter of 40 μm or less, as the added particles with the molten metal having the composition of the matrix shown in Table I. Then, the cast materials of Sample Nos. 7 to 9 were produced by using a continuous casting apparatus 10 provided with, as shown in FIG. 1, a melting-holding furnace 11 for storing molten metals 20 and 21, a partition wall 12 placed at the center of the furnace 11, a cooling mechanism 14 provided in the vicinity of a molten metal-pouring mouth 13 that is provided at a lower position of the furnace 11. The furnace 11 is provided with at its periphery a heating means (not shown) to maintain the temperature of the molten metals 20 and 21 at the specified value. The partition wall 12 is provided so as to be extended to the molten metal-pouring mouth 13 so that the mixing of the molten metals 20 and 21 can be prevented and the molten metals having left the molten metal-pouring mouth 13 can be solidified in a laminated state as shown in FIG. 1. The mixed molten metal 20 is fed into the partition wall 12, and the surface-use molten metal 21 is fed into the space enclosed by the outer circumferential surface of the partition wall 12 and the inner circumferential surface of the furnace 11. The cooling mechanism 14 has a structure in which a circulating coolant (for example, water) is filled in the interior to continuously and efficiently cool the molten metal in the vicinity of the molten metal-pouring mouth 13. The casting apparatus 10 is a vertical-type casting apparatus.

As with Sample Nos. 1 to 6, the cooling rate at the surface side of the cast materials of Sample Nos. 7 to 9 was obtained by placing thermocouples. More specifically, temperatures were measured at the inner surface of the molten metal-pouring mouth and at the surface of the solidifying material (in this case, at a location S at which the molten metal started the contact with the casting mold and a location E at which the surface temperature of the solidifying material reaches the solidus temperature). A thermocouple (in this case, a welded thermocouple of 0.05 mm) was placed at the individual places and on the center portion in the width of the solidifying material continuously emerging from the molten metal-pouring mouth. The length of the section in which the surface temperature of the solidifying material reaches the solidus temperature of the matrix was measured. Then, the value obtained by using formula (3) below was defined as the cooling rate at the surface side.

(the difference between the temperature of the molten metal at the inner surface of the molten metal-pouring mouth and the solidus temperature of the matrix of the cast material)/(the time (sec) during which the cast material travels the section length in which the surface temperature of the cast material just reaches the solidus temperature of the matrix) Formula (3).

The obtained cast materials of Sample Nos. 1 to 8 were subjected to plastic processing (in this case, rolling) with a degree of processing shown in Tables II and III (in this case, a total rolling reduction (%)) to obtain primarily processed materials (in this case, rolled materials). The rolling was performed with a plurality of passes (the rolling reduction per pass: 5% to 30%) by heating the cast material at 300° C. and the roller at 200° C. The cast material of Sample No. 9 was not subjected to the foregoing plastic processing, so that its thickness remained the same as that of the as-cast material. The obtained rolled materials of Sample Nos. 1 to 8 and the obtained cast material of Sample No. 9 were subjected to the examination on the following items: thickness (the final thickness (mm)), composition and the maximum diameter (μm) of the hard particles existing in the surface region and center region, percentage of the volume (vol. %) of the hard particles that have a maximum diameter of more than 20 μm and that exist in the center region, tensile strength (MPa) at room temperature, elongation (%) at room temperature, rigidity, and formability. The examined results are shown in Tables II and III.

The existence of the hard particles can be confirmed, for example, by sampling a cross section at an arbitrary position of the sample to observe the cross section with an X-ray microscope. The cross section is sampled so that hard particles can appear. More specifically, the sheet material is cut such that a plane parallel to the thickness direction appears. The composition of the confirmed hard particles can be obtained after the cross section is mirror-polished, by using, for example, qualitative analysis represented by EDX or the like and semiquantitative analysis. In Tables II and III, the particles of "an Al—Mg family" and "an Mg—Zn family" appear to be precipitated substances, and the particles of "an Si—C family" appear to be the added SiC particles. It is probable that the individual particles having the above-described composition have a coefficient of elasticity of 50 GPa or more, which is sufficiently higher than that of the magnesium alloy that forms the matrix.

Figure 2:
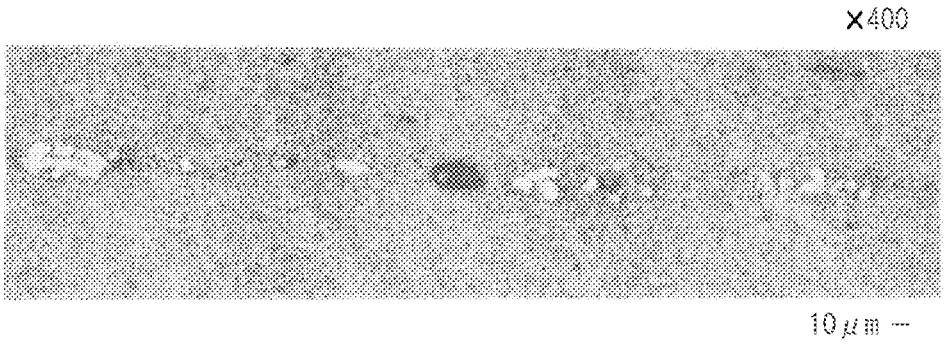
FIG. 2 is a microscope photograph of a cross section of Sample No. 5.

The maximum diameter (μm) of the hard particles can be confirmed by observing the cross section of the sheet material using an optical microscope having a specified magnification (in this case, 400 power). When the observation with an optical microscope is difficult, an X-ray microscope can be used. In the specified measuring area (in this case, an area of the thickness by a width of 3 mm) in the cross section, line segments passing through one hard particle in the thickness direction of the sheet material are defined as diameters of the hard particle and the longest line segment is defined as the maximum diameter of the hard particle. In the measuring area, the maximum diameters of all hard particles existing in each of the surface region, which extends from each surface of the sheet material to a position away from the surface by 45% of the thickness of the sheet material, and the center region, which is positioned in the center of the sheet material and is sandwiched between the two surface regions and which has a thickness of 10% of the thickness of the sheet material are measured to obtain the largest maximum diameter. FIG. 2 shows a microscope photograph of a cross section of Sample No. 5. The photograph shown in FIG. 2 shows a center portion (only a portion having a thickness of 0.15 mm) including the center region of the sheet material, and black particles and whitish particles are hard particles.

The volume percentage (content) of the hard particles having a maximum diameter of more than 20 μm is calculated by the method described below. First, an arbitrary cross section (the plane in which the laminated structure appears) is sampled from the sample. In this cross section, a cross-sectional area, S ($mm^2$), having an area of 1 $mm^2$ or more is observed with an X-ray microscope. Then, the total area, $S_1$ ($mm^2$) of the particles existing in the cross-sectional area S ($mm^2$), and the number, "n," of particles existing in the same cross-sectional area are calculated. The obtained total area $S_1$ ($mm^2$) of the particles is divided by the number "n" to obtain the average cross-sectional area, $S_0$ ($mm^2$), of the particles. The average cross-sectional area $S_0$ ($mm^2$) is substituted into the following formula to obtain the volume percentage.

$$(\text{volume percentage})=(4\times n\times S_0^{1.5})/(3\times S\times \pi). \quad \text{Formula}$$

The rigidity was evaluated by the method described below. The rigidity of Sample No. 1 (a rolled material) was used as the reference (1.00). The individual sheet-shaped samples were processed to obtain the shape of a thin film. The modulus of rigidity was measured through the bending test method, and the relative value of the modulus of rigidity to that of Sample No. 1 was obtained for the evaluation. The bending test was carried out according to JIS Z 2248. The sheet-shaped test piece was placed on two cylindrical supports placed with the spacing of a predetermined distance (250 mm). A pressing metal piece whose tip portion had a hemispherical shape (radius: 10 mm) was pressed against the center portion of the foregoing test piece. The pressing metal piece was gradually advanced to bend the test piece up to a predetermined bending angle (5 degrees). Thus, the counterforce of bending of the test piece was measured. Even when the test piece is smaller than the predetermined shape, it has been confirmed that the bending test can be evaluated by, for example, changing the distance between the points at which the test piece makes contact with the cylindrical supports (hereinafter, this distance is referred to as the contact distance) to conduct a measurement to compare with Sample No. 1. More specifically, it has been confirmed that a measured result comparable to that obtained under the above-described condition can be achieved when the contact distance is 25 mm. The formability (the plastic processibility) was evaluated through the following method. Sample No. 1 (a rolled material) was used as the reference (Δ). Sample Nos. 1 to 8 were subjected to a cupping drawing test at a temperature of 200° C. or more and less than 300° C. with R=5 mm, diameter=40 mm, and depth of drawing=30 mm. Out of n=5 (five samples), the most sound formed body was subjected to the evaluation usually conducted on a formed body, such as cracking on the surface, wrinkle, precision in the form, and so on. The sample was evaluated as "○" when compared with Sample No. 1, the crack had a shallower depth, wrinkles are fewer, and the precision in the form was better. Sample No. 9, which had a thickness different from that of Sample Nos. 1 to 8, was subjected to a cupping drawing test at a temperature of 200° C. or more and 300° C. or less with the use of a die assembly having a larger corner R in proportion to the thickness of the sheet and with a changed drawing speed. Out of n=5 (five samples), the most sound formed body was subjected to the evaluation. The sample was evaluated as "○" when compared with Sample No. 1, which was subjected to the cupping drawing test under the same condition, the surface crack had a shallower depth, wrinkles are fewer, and the precision in the form was better. In addition, the formability test can be conducted by employing a method in accordance with the above-described bending test, in which a sheet-shaped test piece and two cylindrical supports are used. More specifically, after the entire test piece is heated at 150° C. to 350° C., the test piece is supported with the foregoing supports. Bending with a bending angle of 90 degrees is performed by pressing a pressing piece having a thickness four times that of the test piece against the center portion of the test piece. The test piece is removed from the foregoing supports. In the test piece, a cross section perpendicular to the bending axis is subjected to the observation using a loupe, microscope, optical microscope, or another device to inspect the presence or absence of a tear, flaw, and other defects at the outer side of the bent portion. It has been confirmed that this observation result has the same tendency as that of the result of the above-described drawing test.

TABLE II

| | Sample No. | | | | | |
|---|---|---|---|---|---|---|
| | 1 | 2 | 3 | 4 | 5 | 6 |
| Plastic process after casting | Performed | Performed | Performed | Performed | Performed | Performed |
| Degree of processing in plastic processing | 99% | 95% | 95% | 95% | 95% | 95% |
| Final thickness | 0.6 mmt | 0.6 mmt | 0.6 mmt | 0.6 mmt | 0.6 mmt | 0.6 mmt |
| Composition of hard particles | Al—Mg family | Al—Mg family | Al—Mg family | Al—Mg family Mg—Zn family | Al—Mg family Mg—Zn family | Al—Mg family Mg—Zn family |
| Maximum particle diameter in surface region | 40 μm | 20 μm | 20 μm | 20 μm | 20 μm | 4 μm |
| Maximum particle diameter in center region | 40 μm | 40 μm | 20 μm | 40 μm | 40 μm | 40 μm |
| Volume percentage of particles of more than 20 μm | 0.5% | 0.5% | — | 4% | 7% | 7% |
| Tensile strength(MPa) | 270 | 270 | 270 | 300 | 340 | 350 |
| Elongation(%) | 22 | 22 | 24 | 18 | 17 | 18 |
| Rigidity | 1.00 (Reference) | 1.00 | 0.95 | 1.05 | 1.10 | 1.10 |
| Formability | Δ (Reference) | ○ | ○ | ○ | ○ | ○ |

TABLE III

| | Sample No. | | |
|---|---|---|---|
| | 7 | 8 | 9 |
| Plastic process after casting | Performed | Performed | Not performed |
| Degree of processing in plastic processing | 95% | 95% | 0 |
| Final thickness | 0.6 mmt | 0.6 mmt | 2.0 mmt |
| Composition of hard particles | Al—Mg family Si—C family | Al—Mg family Mg—Zn family Si—C family | Al—Mg family Si—C family |

TABLE III-continued

| | Sample No. | | |
|---|---|---|---|
| | 7 | 8 | 9 |
| Maximum particle diameter in surface region | 20 μm | 20 μm | 20 μm |
| Maximum particle diameter in center region | 40 μm | 40 μm | 40 μm |
| Volume percentage of particles of more than 20 μm | 7% | 13% | 4% |
| Tensile strength (MPa) | 340 | 420 | 340 |
| Elongation (%) | 12 | 7 | 10 |
| Rigidity | 1.20 | 1.40 | 1.10 |
| Formability | ○ | ○ | ○ |

As shown in Tables II and III, it is clear that when the hard particles existing in the surface region have a maximum diameter of 20 μm or less and the hard particles existing in the center region have a maximum diameter of more than 20 μm and less than 50 μm, both the cast material and the rolled material have excellent formability and high rigidity. In particular, it is apparent that when hard particles having higher coefficient of elasticity exist, the rigidity becomes higher and the mechanical properties such as tensile strength becomes excellent. In addition, it appears that the sample in which hard particles having a maximum diameter of more than 20 μm exist only in the center region and fine hard particles having a maximum diameter of 20 μm or less exist in the surface region is less likely to cause the foregoing coarse particles to become the starting point of cracking and other defects and has excellent formability.

Figure 3:
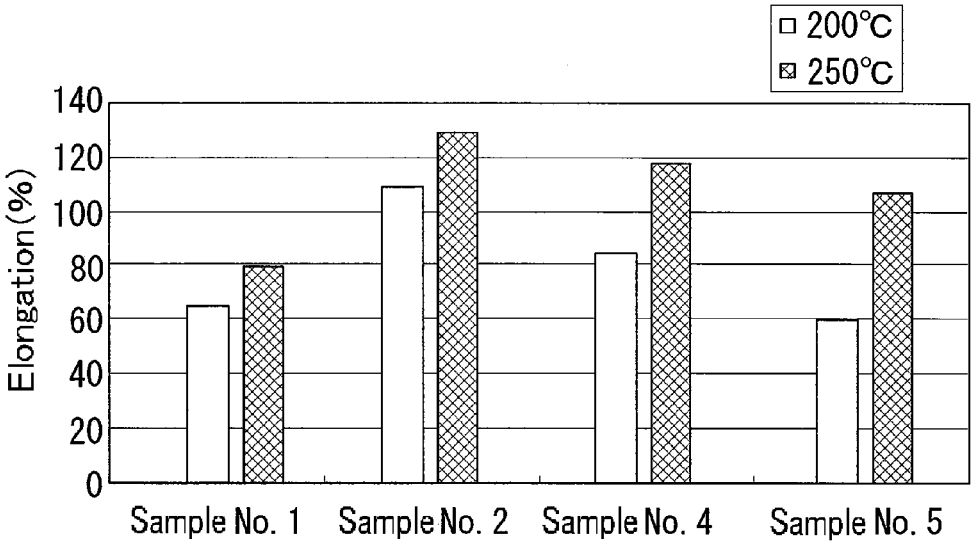
FIG. 3 is a graph showing the elongation in a high-temperature range of the samples produced in an embodiment.

Furthermore, elongation at high temperatures (200° C. and 250° C.) was examined on Sample Nos. 1, 2, 4, and 5. The results are shown in FIG. 3. As shown in FIG. 3, it is apparent that Sample Nos. 2, 4, and 5, in which hard particles existing in the surface region have a maximum diameter of 20 μm or less and hard particles existing in the center region have a maximum diameter of more than 20 μm and less than 50 μm, also have excellent mechanical properties at high temperatures.

Because the above-described rolled materials (Sample Nos. 2 and 4 to 8) have excellent formability, they can be expected to be suitably used as a raw workpiece for pressing processing, for example. In particular, it is likely that samples having excellent mechanical properties at high temperatures can reduce breaking at the corner portion in the pressing forming and deep drawing, for example. When the obtained pressing-processed material (formed body) is provided with an anticorrosion layer or painted layer, the anticorrosion property or commercial value can be increased.

In addition, the obtained cast materials of Sample Nos. 1 to 9 were heat-treated for 30 minutes to 50 hours at a temperature range of 250° C. to 600° C. and not higher than their solidus temperature. The individual samples were heat-treated under a plurality of conditions in the foregoing temperature range and time span. In the foregoing temperature range and time span, although the degree of variation is small, it has been confirmed that the size of the particles (precipitated substances) existing in the interior of the cast material is decreased. This result enables the proper selection of the desired heat-treating condition based on the size (diameter) of the particles existing in the cast material and the size (diameter) of the particles to be contained in the final product. For example, to decrease the size of the particles existing in the final product, it is desirable to perform heat treatment as often as possible. A columnar crystal structure, however, recrystallizes into a granular structure by the heat treatment, increasing the crystal size. For example, in a magnesium alloy composed of 9 mass % aluminum, 1 mass % zinc, and the remainder being magnesium and unavoidable impurities, when the crystal size is increased to 300 μm or more, the plastic processibility is worsened. Moreover, it is undesirable to perform excessively prolonged heat treatment in terms of energy use. Consequently, when a cast material is heat-treated, the desirable temperature range is from 250° C. to 600° C. and not higher than the solidus temperature. It is more desirable that the temperature range be from 300° C. to 400° C. to perform the heat treatment safely and efficiently in a short time. On the other hand, the desirable time range is from 30 minutes to 50 hours. As described above, considering the safety and efficiency, it is more desirable that the time range be from 3 to 30 hours, particularly desirably from 10 to 15 hours. After the completion of the heat treatment, when rapid cooling is conducted, not only can the surface of the cast material be prevented from oxidizing to obtain a product having excellent surface properties but also brittle particles can be prevented from forming at the crystal interface to improve the plastic processibility, which is desirable. It is desirable that the cooling rate be 10° C./min or more. As described above, considering the safety and efficiency, it is more desirable that the cooling rate be 50° C./min or more, particularly desirably 500° C./min or more.

The above-described embodiments can be modified as appropriate without deviating from the gist of the present invention. The embodiments are not limited to the above-described structure, constitution, or composition. For example, the composition of the magnesium alloy, the composition of the added hard particles, and the like can be modified as appropriate.

INDUSTRIAL APPLICABILITY

The magnesium alloy sheet material of the present invention has excellent plastic processibility in the processing such as pressing and forging. Consequently, it can be suitably used as the raw workpiece for the above-described forming processing. The magnesium alloy formed body of the present invention can be suitably used as the structural member in the field that requires the reduction in weight, such as housing cases of portable electrical devices, parts of automobiles, and so on.

The invention claimed is:

1. A magnesium alloy sheet material, being a sheet material comprising magnesium alloy, wherein:

(a) the magnesium alloy forms a matrix that contains hard particles; and (b) when in the thickness direction of the sheet material, a region from each surface of the sheet material to a position away from the surface by 40% of the thickness of the sheet material is defined as a surface region and the remaining region is defined as the center region, hard particles existing in the center region have a maximum diameter of 40 μm or more and less than 50 μm and hard particles existing in the surface region have a maximum diameter of 20 μm or less, and wherein the hard particles include Al—Mg-family precipitated substances, Al—Mn-family precipitated substances, Mg—Zn-family precipitated substances, boron nitride, or diamond, and the diameter of the hard particles is smaller in the surface region than at the center region by at least controlling the cooling conditions in a casting step carried out during a production of the magnesium alloy sheet material.

2. The magnesium alloy sheet material as defined by claim 1, wherein the hard particles existing in the surface region have a maximum diameter of 5 μm or less.

3. The magnesium alloy sheet material as defined by claim 2, wherein the sheet material is already subjected to a rolling processing with a total rolling reduction of 20% or more.

4. The magnesium alloy sheet material as defined by claim 1, wherein the sheet material is already subjected to a rolling processing with a total rolling reduction of 20% or more.

5. The magnesium alloy sheet material as defined by claim 1, wherein the matrix forming the surface region comprises a magnesium alloy that contains aluminum with a content of 2.5 mass % or more and less than 6.5 mass % and that contains silicon and calcium with a content of 0.5 mass % or less in total.

6. The magnesium alloy sheet material as defined by claim 1, wherein the matrix forming the surface region comprises a magnesium alloy that contains aluminum with a content of 6.5 mass % or more and 20 mass % or less and that contains silicon and calcium with a content of 0.5 mass % or less in total.

7. The magnesium alloy sheet material as defined by claim 1, wherein the hard particles existing in the center region account for 0.5 vol. % or more and less than 15 vol. % of the total volume of the sheet material.

8. The magnesium alloy sheet material as defined by claim 1, wherein the hard particles existing in the center region comprises precipitated substances.

9. The magnesium alloy sheet material as defined by claim 1, wherein the sheet material is provided with a covering layer on its surface.

10. A magnesium alloy formed body, being formed by performing a plastic processing on the magnesium alloy sheet material as defined by claim 1.

11. The magnesium alloy formed body as defined by claim 10, the formed body being provided with a covering layer on its surface.

12. The magnesium alloy sheet material as defined by claim 1, wherein the hard particles further include carbide, nitride, or intermetallic compounds including at least Mg or Al.

13. The magnesium alloy sheet material as defined by claim 1, wherein the magnesium alloy sheet has a tensile strength of from 270 MPa to 420 MPa.

14. The magnesium alloy sheet material as defined by claim 1, wherein the diameter of the hard particles is further controlled by performing at least one from a heat treatment, rolling and extrusion after the casting step.

15. A magnesium alloy sheet material, being a sheet material comprising magnesium alloy, wherein:

(a) the magnesium alloy forms a matrix that contains hard particles; and (b) when in the thickness direction of the sheet material, a region from each surface of the sheet material to a position away from the surface by 40% of the thickness of the sheet material is defined as a surface region and the remaining region is defined as the center region, hard particles existing in the center region have a maximum diameter of 40 μm or more and less than 50 μm and hard particles existing in the surface region have a maximum diameter of 20 μm or less, and wherein the hard particles include intermetallic compounds including at least one element selected from Al, Mg, Zn, or Mn, boron nitride, or diamond, and the diameter of the hard particles is smaller in the surface region than at the center region by at least controlling the cooling conditions in a casting step carried out during a production of the magnesium alloy sheet material.

16. The magnesium alloy sheet material as defined by claim 15, wherein the magnesium alloy sheet has a tensile strength of from 270 MPa to 420 MPa.

17. The magnesium alloy sheet material as defined by claim 15, wherein the diameter of the hard particles is further controlled by performing at least one from a heat treatment, rolling and extrusion after the casting step.

* * * * *